US012800244B2

(12) United States Patent
Brussow et al.

(10) Patent No.: US 12,800,244 B2
(45) **Date of Patent: *Nov. 17, 2026**

(54) COMPONENTS (AIR INLET LOUVER PANELS) FOR COOLING WATER MANAGEMENT SYSTEMS

(71) Applicants: Bradley J. Brussow, Belmont, MI (US); Ed Kroll, Whitehall, MI (US)

(72) Inventors: Bradley J. Brussow, Belmont, MI (US); Ed Kroll, Whitehall, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/303,627

(22) Filed: Aug. 19, 2025

(65) Prior Publication Data

US 2026/0118074 A1 Apr. 30, 2026

Related U.S. Application Data

(63) Continuation of application No. 18/926,551, filed on Oct. 25, 2024, now Pat. No. 12,392,568.

(51) Int. Cl.

| | |
|---|---|
| ***F28F 25/12*** | (2006.01) |
| ***F28F 19/04*** | (2006.01) |
| ***F28F 19/06*** | (2006.01) |

(52) U.S. Cl.

CPC ..... *F28F 25/12* (2013.01); *F28F 19/04* (2013.01); *F28F 19/06* (2013.01)

(58) Field of Classification Search

None

See application file for complete search history.

(56) References Cited

U.S. PATENT DOCUMENTS

| | | | | |
|---|---|---|---|---|
| 3,669,425 | A * | 6/1972 | Copeland | F28C 1/00 261/109 |
| RE41,594 | E * | 8/2010 | Lambert | H05K 9/0041 174/383 |
| 2004/0092620 | A1* | 5/2004 | Kobayashi | F28F 13/18 524/10 |
| 2005/0133025 | A1* | 6/2005 | Laiho | A61M 15/0045 128/200.23 |
| 2007/0207722 | A1* | 9/2007 | McLeod | F24F 11/0001 454/229 |
| 2008/0083239 | A1* | 4/2008 | Meyer | F24F 13/20 62/305 |
| 2008/0250601 | A1* | 10/2008 | Coburn | A47L 5/24 15/352 |
| 2008/0286163 | A1* | 11/2008 | Garfield | F24F 8/167 427/532 |
| 2011/0171094 | A1* | 7/2011 | Zahedi | B01D 53/864 422/186.07 |
| 2013/0087134 | A1* | 4/2013 | Mikulec | F24C 15/2021 126/299 D |

(Continued)

FOREIGN PATENT DOCUMENTS

| | | | |
|---|---|---|---|
| CN | 1844824 A | * | 10/2006 |
| CN | 201392109 Y | * | 1/2010 |

*Primary Examiner* — Ko-Wei Lin

(74) *Attorney, Agent, or Firm* — King & Partners, PLC

(57) ABSTRACT

An air inlet louver panel for use in association with a water-cooling tower, including: (a) a core, wherein the core includes an outer surface; (b) a frame assembly, wherein the frame assembly is associated with the core; and (c) wherein at least a portion of the outer surface of the core is associated with an anti-fouling coating.

20 Claims, 5 Drawing Sheets

(56) References Cited

U.S. PATENT DOCUMENTS

| | | | | |
|---|---|---|---|---|
| 2013/0104510 | A1* | 5/2013 | Augustine | A01D 46/16 56/41 |
| 2014/0264973 | A1* | 9/2014 | Aaron | F28C 1/02 261/128 |
| 2015/0135661 | A1* | 5/2015 | MacDonald | F24F 13/08 55/440 |
| 2017/0321908 | A1* | 11/2017 | Hua | F24F 6/12 |
| 2020/0011483 | A1* | 1/2020 | Alzaydi | F17C 1/14 |
| 2020/0061231 | A1* | 2/2020 | Jeong | B01D 46/64 |
| 2020/0072527 | A1* | 3/2020 | Acar | F25D 17/065 |
| 2021/0131177 | A1* | 5/2021 | Vande Haar | E06B 9/54 |
| 2021/0291096 | A1* | 9/2021 | Bergami | B01D 46/4263 |
| 2021/0404678 | A1* | 12/2021 | Tanaka | B01D 46/0036 |
| 2022/0387657 | A1* | 12/2022 | Eggers | F24F 11/70 |
| 2023/0135061 | A1* | 5/2023 | Nanayakkara | F24F 8/24 422/121 |
| 2024/0068681 | A1* | 2/2024 | Senkbeil, Jr. | B01D 46/0005 |
| 2024/0110087 | A1* | 4/2024 | Kagawa | C09D 5/1662 |

* cited by examiner

COMPONENTS (AIR INLET LOUVER PANELS) FOR COOLING WATER MANAGEMENT SYSTEMS

COPYRIGHT NOTICE

This application includes material that is subject to copyright protection. The copyright owner has no objection to the facsimile reproduction by anyone of the patent disclosure, as it appears in the United States Patent and Trademark Office files or records, but otherwise reserves all copyright rights whatsoever.

CROSS-REFERENCE TO RELATED APPLICATIONS

This application is a continuation of U.S. application Ser. No. 18/926,551, entitled "COMPONENTS (AIR INLET LOUVER PANELS) FOR COOLING WATER MANAGEMENT SYSTEMS," filed Oct. 25, 2024, now U.S. Pat. No. 12,392,568, which relates to U.S. application Ser. No. 17/898,741, entitled "COOLING WATER MANAGEMENT SYSTEMS AND ASSOCIATED METHODS FOR USING THE SAME," filed Aug. 30, 2022—which is hereby incorporated herein by reference in its entirety, including all references cited therein.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

The present invention relates in general to component parts for water cooling towers, and, more particularly, to improved air inlet cooling tower louver panels that are surface treated with a high lubricity coating that causes water to bead and not break surface tension. As such, the water, along with dissolved solids, slide off the air inlets reducing buildup of solids caused by evaporation. The coating also makes removing buildup much easier than traditional air inlet panels that are not surface coated/treated. Additional benefits of the improved air inlet cooling tower louver panels of the present invention include, among other things, easier and less frequent cleaning, less damage to air inlets which results in less frequent replacement, higher cycles of concentration are possible because of delayed fouling, lower chemical costs, lower labor costs, and less risk to chillers and other equipment because air flow remains uninterrupted and/or otherwise compromised.

2. Background Art

Water management systems and associated components have been known in the art for years, and are the subject of a plurality of patents including, for example: U.S. Pat. No. 8,223,495 entitled "Electronic Device Cooling System," U.S. Pat. No. 5,145,585 entitled "Method and Apparatus for Treating Water in a Cooling System," U.S. Pat. No. 4,764,283 entitled "Method and Apparatus for Treating Cooling Tower Water," U.S. Pat. No. 4,519,919 entitled "Method and Apparatus for Magnetically Treating Fluids," U.S. Pat. No. 4,202,847 entitled "Apparatus and Method for Cooling Water Especially in Cooling Towers," U.S. Pat. No. 4,172,786 entitled "Ozonation of Cooling Tower Waters," U.S. Pat. No. 4,153,559 entitled "Water Treatment Device and Method for Manufacturing Same," U.S. Pat. No. 3,997,635 entitled "Method and Device for Evaporative Cooling," U.S. Pat. No. 3,669,425 entitled "Water Cooling Tower," Chinese Patent Number 201392109 entitled "Closed Type Cooling Tower," Chinese Patent Number 2906512 entitled "Energy-Saving Environmental-Protection Cooling Tower," and Chinese Patnet Number 1844824 entitled "Environment-Friendly Water-Saving Cooling Tower"—all of which are hereby incorporated herein by reference in their entirety including all references cited therein.

U.S. Pat. No. 8,223,495 appears to disclose cooling systems for providing cooled air to electronic devices. The systems can include large storage tanks or waste treatment systems to improve the efficiency of the plant and reduce impact on the environment.

U.S. Pat. No. 5,145,585 appears to disclose a method for treating water in a cooling system that includes a cooling tower and heat exchanger. The method includes the steps of removing water from the main cooling water circuit, serially subjecting the water to magnetic treatment, treatment with ozone, filtering with a centrifugal separator, and then returning to the main cooling water circuit. Underflow from the centrifugal separator is filtered with a bag filter, and the filtered water returned to the magnetic treatment step. The pH of the water may be controlled by regulating the production of dry air supplied to the ozone generator.

U.S. Pat. No. 4,764,283 appears to disclose an apparatus and method of reducing agglomeration of fluids consisting of the vigorous agitation of the liquid by a double opposed vortex nozzle and the passing of the liquid through a magnetic field. One of the opposed nozzles may have ozone gas forced through it for treating sewage. The apparatus and method may also be used to treat cooling tower water.

U.S. Pat. No. 4,519,919 appears to disclose an apparatus for and method of magnetically treating flowing fluids that includes a housing into which a fluid stream is directed and in which the stream is divided into a plurality of separate flow paths. Each of the flow paths within the housing is subjected to a monopolar magnetic influence and a baffle configured to induce turbulence in the flow path to insure exposure of all of the fluid in the path to the monopolar magnetic influence. The separate flow paths are at least partially recombined to a single flow path and discharged from the housing.

U.S. Pat. No. 4,202,847 appears to disclose a water cooling tower and method which provides for both wet and dry cooling within the same vertical space and significantly reduces the discharge of water particles out of the tower. Water is deposited on one side of each of a plurality of trickler plates and flows downwardly under the influence of gravity substantially undisturbed as a low speed film. Air flows at low speed by natural draught in a substantially undisturbed path on the other side of each of the plates.

U.S. Pat. No. 4,172,786 appears to disclose a continuous ozone injection into water that circulates between a cooling tower and heat exchanger with heavy scale deposits inhibits formation of further deposits, promotes flaking of existing deposits, inhibits chemical corrosion and controls algae and bacteria.

U.S. Pat. No. 4,153,559 appears to disclose a device for the magnetic treatment of water and other liquids, having a pair of concentric tubular casings which are spaced from each other so as to form an annular treatment chamber. The inner casing contains an elongated magnet having two or more longitudinally spaced poles, and the outer casing is made of a magnetic material which serves to concentrate the magnetic lines of force within the annular chamber. The inner casing is supported within the outer casing by means of elastic, non-magnetic sleeves which are positioned over opposite ends of the inner casing and compressed between it and the inner surface of the outer casing so that the treatment chamber is rendered fluid-tight and the inner casing and magnet are prevented from shifting longitudinally with respect to the outer casing. The device is manufactured by pressing resilient end caps on opposite ends of the magnet and pressing this assembly into the inner casing, inserting the inner casing in the outer casing and then wedging the sleeves between them.

U.S. Pat. No. 3,997,635 appears to disclose a method and a device for preventing formation of mist by the discharge of moistened air from an evaporative cooler, primarily a cooling tower of the multi-layer type, comprising a contact body composed of a plurality of layers forming between themselves gaps passed by water to be cooled and atmospheric air which is moistened and heated by contact with the water in counter-current or cross-current flow. Under certain conditions as when the temperature of the atmospheric air is so low, when the moistened and heated air is discharged to the atmosphere and cooled to the low temperature of the latter, the moisture contained in the discharged air will be condensed and precipitated in the form of mist to the extent it exceeds the saturation point of the air. Such precipitation can be avoided by mixing the moistened air prior to its escape into the atmosphere with preheated dry air. The invention provides a novel method and device for producing such preheated dry air by causing part of the introduced atmospheric air to pass through gaps of the contact body shut off from the flow of water passing through the body, whereby this air is heated without change of its moisture content by heat exchange with the warm water flowing through adjacent gaps. The moist air current from the gaps wetted by the water flowing through them and the dry air current from the gaps not accessible to the water provided an air mixture which, even when discharged into the relatively cold atmospheric air and thereby cooled to the low temperature thereof, will not contain so much moisture that the saturation limit is surpassed and condensed vapor precipitated. Means are also disclosed to adjust the ratio of the gaps open to the water flow to the gaps shut off from said flow so as to reduce the number of dry gaps in which no cooling effect is produced to the minimum necessary for avoiding mist formation.

U.S. Pat. No. 3,669,425 appears to disclose a water cooling tower which comprises a blower opening into the bottom of the tower for introducing or blowing air into the tower. A continuously walled wet decking arranged in a spiral mounted above the air inlet port and having a large number of regularly spaced projections arranged in an inclined checkerboard or step like pattern to control the counterflowing air and water in the tower. A spray tree for introducing water into the vessel is mounted above the wet decking and a mist eliminator is mounted above the spray tree. The mist eliminator is also constructed in the form of a continuously spirally wound vertical wall with adjacent surfaces of the eliminator wall being separated by a multiplicity of step like baffles.

Chinese Patent Number 201392109 appears to disclose a closed type cooling tower, which includes a fan arranged at the top of the tower, a water-catching tank arranged at the bottom of the tower, a medium inlet and a medium outlet, a heat exchanger coil arranged in the tower and a spraying water-distributing system, wherein two ends of the heat exchanger coil are respectively communicated with the medium inlet and the medium outlet; the spraying water-distributing system is connected to the water-catching tank through a cycling water pump; moreover, the spraying water-distributing system is also provided with a plurality of nozzles, wherein the heat exchanger coil is formed by a capillary; as the capillary is characterized by large heat exchange area, thin wall, good thermal conductivity, uniform heat exchange, and the like, by adopting the capillary as the heat exchanger coil, on one hand, the heat exchange effect of the cooling tower can be improved, on the other hand, under the condition of equal heat exchange requirement, the heat exchanger coil which is formed by the capillary can be designed to be smaller, thereby leading the volume of the cooling tower to be smaller.

Chinese Patent Number 2906512 appears to disclose a water-saving and environment-friendly cooling tower, which relates to a cooling device for cooling the circulating water. An air intake shutter of air cooler is symmetrically arranged on the sidewall of the cooling tower body, an air cooler is arranged close to the air intake shutter, a distributing pipe in the air cooler inside is connected with a circulating water intake pipe, an outlet pipe of the air cooler is connected with a water distributor, a lower catchment tank of the air cooler is connected with a circulating water outlet pipe by a bypass pipe. The air cooler is arranged above a water collector, the water distributor is arranged between the two air coolers. The utility model is water saving, the air cooler is used to precool the circulating water, the cooling load of the filler segment and the quantity of the evaporated water are decreased. The air becomes hot and dry when going through the air cooler and the humidity of the hot wet air, which can reduce the humidity ratio of the hot and wet air after being exchanged in the filler layer, and the water fog generated at the top of the tower is avoided or reduced, which is favorable to environmental protection.

Chinese Patent Number 1844824 appears to disclose an environment-friendly water-saving cooling tower, wherein the side wall of the tower is symmetrically distributed with wind inlet shutters of air cooler; the inner side that is near to the shutters is distributed with an air cooler; the water distributing tube at the inner side of air cooler is through to the water inlet tube of cycle water, while the water outlet tube of air cooler is through to the water distributor; the lower water tank of air cooler via the branch tube is through to the reflux tube of recycle water; the air cooler is above the water collector; the water distributor is between two air coolers. The invention uses an air cooler to pre-cool the cycle water, to reduce the load, the steam amount, and the water consumption.

While the above-identified patents do appear to disclose various water management systems and associated components, their configurations remain non-desirous and/or problematic inasmuch as, among other things, none of the above-identified systems appear to disclose improved air inlet cooling tower louver panels that are surface treated with a high lubricity coating.

These and other objects of the present invention will become apparent in light of the present specification, claims, and drawings.

SUMMARY OF THE INVENTION

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

The present invention is directed to an air inlet louver panel for use in association with a water-cooling tower, comprising, consisting essentially of, and/or consisting of: (a) a core, wherein the core includes an outer surface; (b) a frame assembly, wherein the frame assembly is associated with the core; and (c) wherein at least a portion of the outer surface of the core is associated with an anti-fouling coating.

In a preferred embodiment of the present invention, the core comprises an air permeable mesh.

In another preferred embodiment of the present invention, the core comprises at least one honeycomb construction layer.

In yet another preferred embodiment of the present invention, the core is fabricated from at least one of stainless steel, galvanized steel, aluminum, a polyurethane laminate, a bead-shaped activated carbon, and combinations thereof.

In one embodiment of the present invention, the core is fabricated from a thermoplastic. In this embodiment, the thermoplastic is preferably selected from the group consisting of an acrylic, an acrylonitrile butadiene styrene, a polyamide, a polylactide, a polybenzimidazole, a polycarbonate, a polyether sulfone, a polyoxymethylene, a polyether ether ketone, a polyetherimide, a polyethylene, a polyphenylene oxide, a polyphenylene sulfide, a polypropylene, a polystyrene, a polyvinyl chloride, and combinations thereof.

In a preferred implementation of the present invention, the frame assembly contacts and surrounds the perimeter of the core.

In another preferred implementation of the present invention, the frame assembly is fabricated from at least one of stainless steel, galvanized steel, and/or aluminum.

In yet another preferred implementation of the present invention, the anti-fouling coating is at least one of impregnated, etch coated, dip coated, spin coated, brush coated, and spray coated onto/into the at least a portion of the outer surface of the core.

In one preferred implementation of the present invention, the anti-fouling coating is at least one of impregnated, etch coated, dip coated, spin coated, brush coated, and spray coated onto/into the entire outer surface of the core.

In one aspect of the present invention, the anti-fouling coating comprises a ceramic polymer, a synthetic fluoropolymer of tetrafluoroethylene, and/or an aluminum magnesium boride.

In a preferred embodiment of the present invention, the air inlet louver panel further comprises a splash deflector associated with the frame assembly.

The present invention is also directed to an air inlet louver panel for use in association with a water-cooling tower, comprising, consisting essentially of, and/or consisting of: (a) a core, wherein the core includes an outer surface, and wherein the core comprises a polyvinyl chloride; (b) a frame assembly, wherein the frame assembly is associated with the core, and wherein the frame assembly comprises stainless steel; and (c) wherein at least a portion of the outer surface of the core is associated with an anti-fouling coating, wherein the anti-fouling coating comprises at least one of a ceramic polymer, a synthetic fluoropolymer of tetrafluoroethylene, and aluminum magnesium boride.

The present invention is yet also directed to an air inlet louver panel for use in association with a water-cooling tower, consisting of: (a) a core, wherein the core includes an outer surface, and wherein the core consists of a polyvinyl chloride; (b) a frame assembly, wherein the frame assembly is associated with the core, and wherein the frame assembly consists of stainless steel; and (c) wherein at least a portion of the outer surface of the core is associated with an anti-fouling coating, and wherein the anti-fouling coating consists of a ceramic polymer.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted.

It will be further understood that the invention is not necessarily limited to the particular embodiments illustrated herein.

Figure 1:
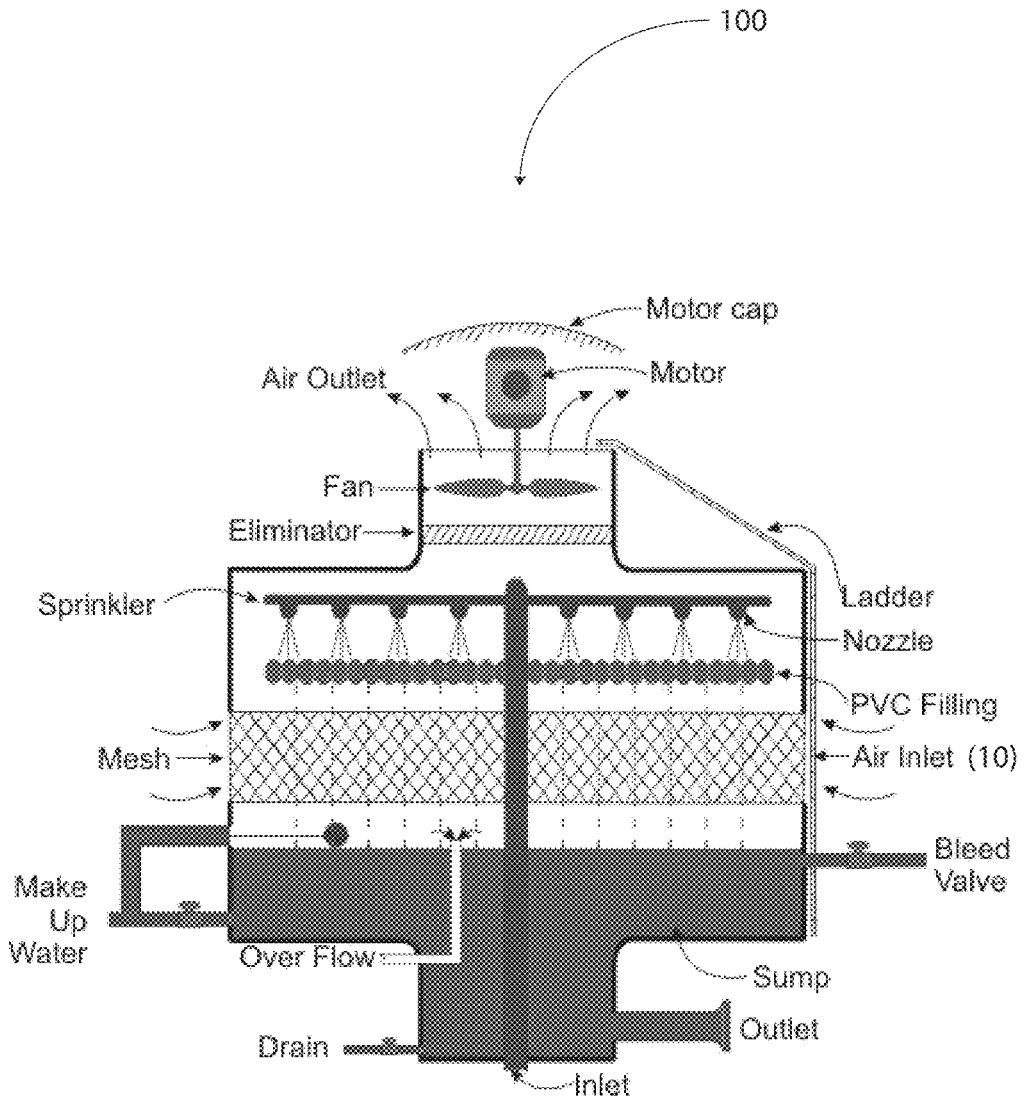
Figure 2:
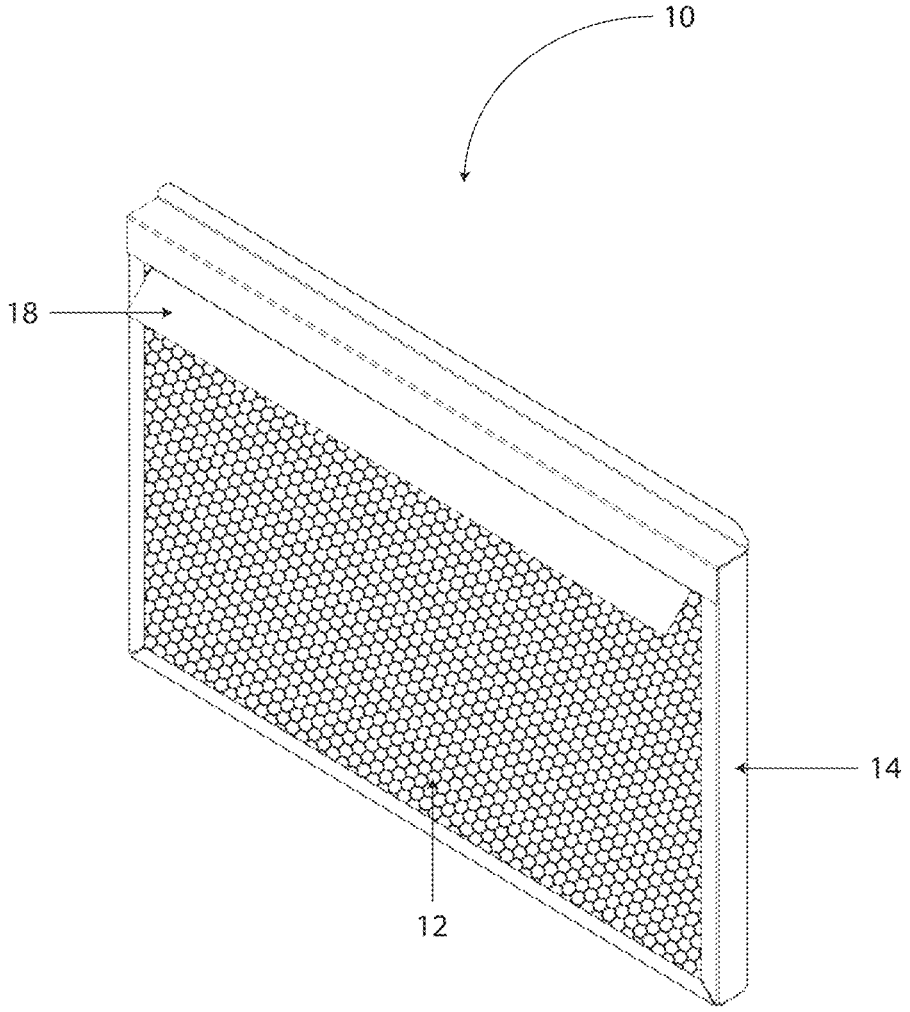
Figure 3:
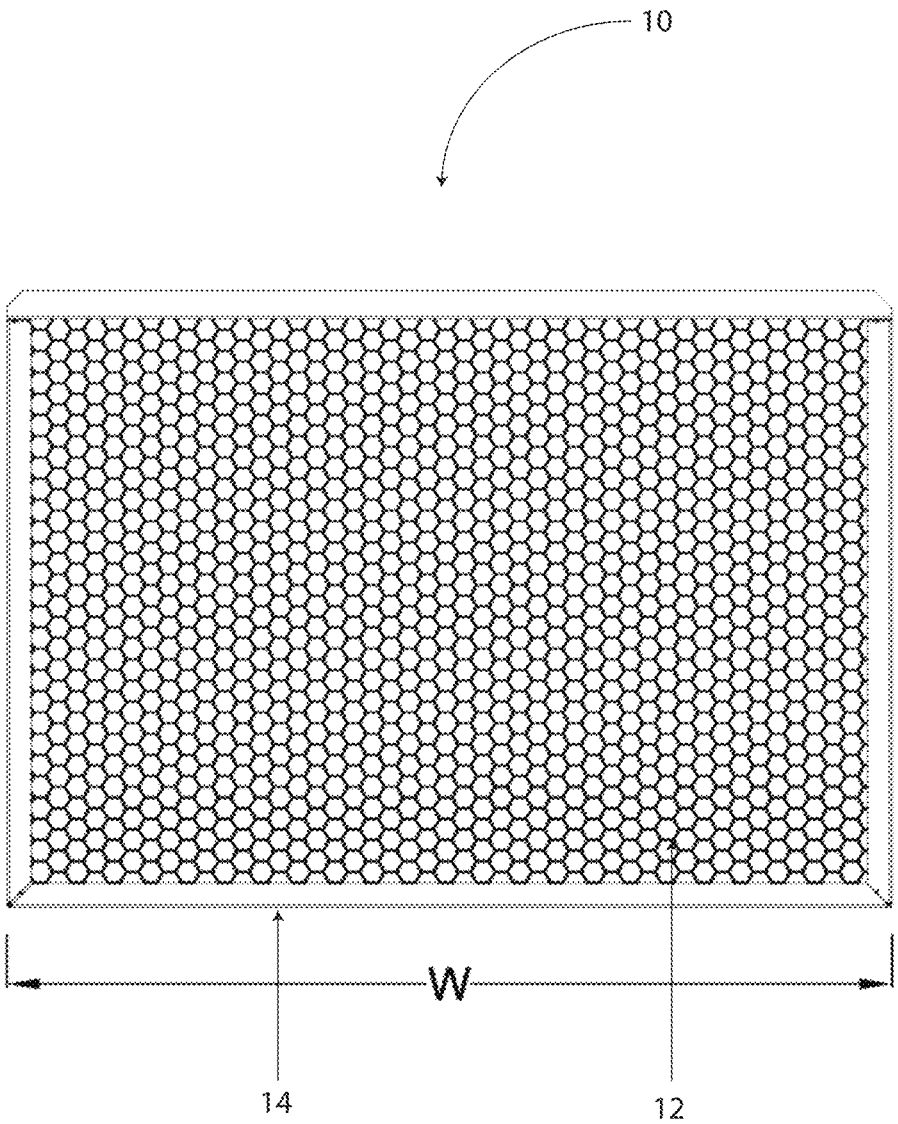
Figure 4:
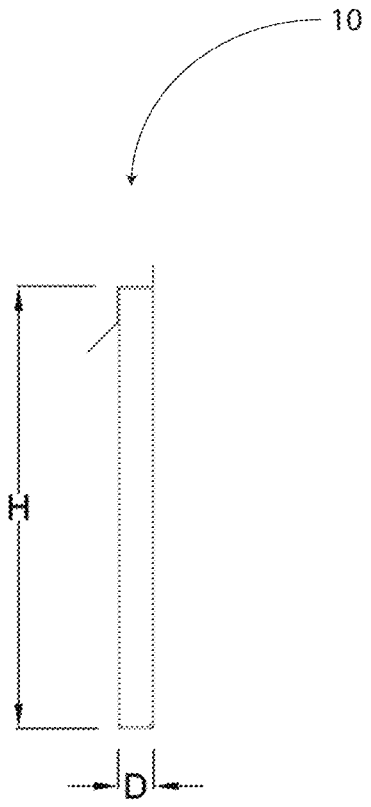
Figure 5:
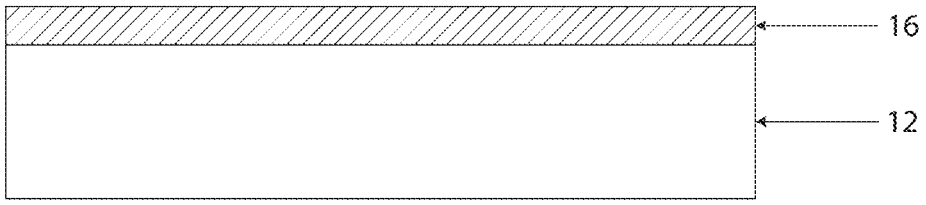

The invention will now be described with reference to the drawings wherein:

FIG. 1 of the drawings is a schematic diagram of a water cooling tower using an air inlet louver panel of the present invention;

FIG. 2 of the drawings is a perspective view of an air inlet louver panel of the present invention;

FIG. 3 of the drawings is a front view of the air inlet louver panel of FIG. 2;

FIG. 4 of the drawings is a side view of the air inlet louver panel of FIG. 2; and FIG. 5 of the drawings is fragmented, cross sectional view of the core of the present invention associated with an anti-fouling coating.

DETAILED DESCRIPTION OF THE INVENTION

While this invention is susceptible of embodiment in many different forms and applications, there are shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of one or more embodiments of the invention, and some of the components may have been distorted from their actual scale for purposes of pictorial clarity.

Referring now to the drawings, and to FIG. 1 in particular, the present invention is directed to an improved component part for water cooling system 100. In particular, as is also shown in FIGS. 2-4, the improved component is air inlet louver panel 10 that has a core surface treated with a high lubricity coating that causes water to bead and not break surface tension. As such, the water, along with dissolved solids, slide off the air inlets reducing buildup of solids caused by evaporation. The coating also makes removing buildup much easier than traditional air inlet panels that are not surface coated/treated. Additional benefits of the improved air inlet cooling tower louver panels of the present invention include, among other things, easier and less frequent cleaning, less damage to air inlets which results in less frequent replacement, higher cycles of concentration are possible because of delayed fouling, lower chemical costs, lower labor costs, and less risk to chillers and other equipment because air flow remains uninterrupted and/or otherwise compromised.

By way of further explanation, and as is shown in FIG. 1, water cooling system 100 generally works by having hot water enter the tower and is pumped to the header, which has nozzles and sprinklers to spray the water, increasing its surface area. The water then passes through PVC filling to slow its speed. Fans at the top of the tower pull air from the bottom to the top. The slow speed and increased contact area of the water enhance the interaction between air and water. This reduces the water's temperature through evaporation. The cooled water is then collected at the bottom of the tower and reused in the boiler or other heating/cooling system. A non-exhaustive list of relevant parts of the water cooler include: (1) the eliminator (It is not allowed to pass water. The eliminator is placed the at top of tower, from which only hot air can pass); (2) spray nozzles and header (These parts are used to increase the rate of evaporation by increasing surface area of water); (3) PVC falling (It reduces the falling speed of hot water and it is similar to a beehive); (4) mesh or air inlet cooling tower louver panels 10 (When the fan is ON, it uses atmosphere air which contains some unwanted dust particles. Mesh is used to stop these particles and do not allow to enter dust into the cooling tower); (5) float valve (It is used to maintain level of water); (6) bleed valve (It is used to control the concertation of minerals and salt); and (7) body (The body or outer surface of cooling tower is often made up from fiber reinforced plastic (FRP), which protects the internal parts of cooling tower.

As is best shown in FIGS. 2-5, air inlet louver panel 10 for use in association with a water-cooling tower 100 (see FIG. 1), generally comprises: core 12 that includes an outer surface; frame assembly 14 (generally defined by a height (H), a width (W), and a depth (D)) that is associated with core 12; and high-lubricity, anti-fouling coating 16 associated with core 12. Air inlet louver panel 10 prohibits the light of the sun from entering the cooling tower basin. Installing air inlet louvers helps control the growth of algae. Controlling the light and limiting algae growth means lowering chemical costs. Air inlet louvers also help lower the amount of splash-out from the cooling tower. This reduces the amount of water and chemical needed to run the cooling tower efficiently. Also, the user will experience easier basin access and removal. Without proper care and maintenance, the air inlet louvers in cooling towers with counterflow can quickly become scaled from calcium solids and foul. If this happens it reduces cooling tower efficiency. Louvers that are scaled lessen the air flow to the unit thus lessening the efficiency. The louvers of the present invention do not scale because they are associated with a high-lubricity, anti-fouling coating.

In one embodiment of the present invention, core 12 comprises an air permeable mesh and/or at least one honeycomb construction layer. Preferably, core 12 is fabricated from at least one of stainless steel, galvanized steel, aluminum, a polyurethane laminate, a bead-shaped activated carbon, a thermoplastic, and combinations thereof. In one embodiment, the thermoplastic is selected from the group consisting of an acrylic, an acrylonitrile butadiene styrene, a polyamide, a polylactide, a polybenzimidazole, a polycarbonate, a polyether sulfone, a polyoxymethylene, a polyether ether ketone, a polyetherimide, a polyethylene, a polyphenylene oxide, a polyphenylene sulfide, a polypropylene, a polystyrene, a polyvinyl chloride, and combinations thereof.

As is best shown in FIGS. 2-4, frame assembly 14 preferably contacts and surrounds the perimeter of core 12. Frame assembly 14 is preferably fabricated from at least one of stainless steel, galvanized steel, and/or aluminum.

In accordance with the present invention, anti-fouling coating 16 is at least one of impregnated, etch coated, dip coated, spin coated, brush coated, and spray coated onto/into the at least a portion of and/or the entire outer surface of core 12.

In a preferred embodiment of the present invention, anti-fouling coating/layer 16 comprises a ceramic polymer, a synthetic fluoropolymer of tetrafluoroethylene, an aluminum magnesium boride having a molecular weight of 202.64, and/or $AlMgB_{14}$.

Air inlet louver panel 10 can also include splash deflector 18 associated with frame assembly 14.

It will be understood that novel air inlet louver panels 10 of the present invention can also materially increase the efficiency and longevity of cooling water management systems, including, but not limited to, those disclosed in U.S. application Ser. No. 17/898,741, entitled "COOLING WATER MANAGEMENT SYSTEMS AND ASSOCIATED METHODS FOR USING THE SAME," filed Aug. 30, 2022-which is hereby incorporated herein by reference in its entirety, including all references cited therein.

The foregoing description merely explains and illustrates the invention and the invention is not limited thereto except insofar as the appended claims are so limited, as those skilled in the art who have the disclosure before them will be able to make modifications without departing from the scope of the invention.

While certain embodiments have been illustrated and described, it should be understood that changes and modifications can be made therein in accordance with ordinary skill in the art without departing from the technology in its broader aspects as defined in the following claims.

The embodiments, illustratively described herein may suitably be practiced in the absence of any element or elements, limitation or limitations, not specifically disclosed herein. Thus, for example, the terms "comprising," "including," "containing," etcetera shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The present disclosure is not to be limited in terms of the particular embodiments described in this application. Many modifications and variations can be made without departing from its spirit and scope, as will be apparent to those skilled in the art. Functionally equivalent methods and compositions within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can of course vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etcetera. As a non-limiting example, each range discussed herein can be readily broken down into a lower third, middle third and upper third, etcetera. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims.

What is claimed and desired to be secured by Letters Patent of the United States is:

1. An air inlet louver panel for use in association with a water-cooling tower, comprising:

a core, wherein the core includes an outer surface;

a frame assembly, wherein the frame assembly is attached to the core; and wherein at least a portion of the outer surface of the core is in direct contact with a anti-fouling coating, wherein the anti-fouling coating causes water to bead and not break surface tension such that water and dissolved solids slide off the air inlet louver panel reducing buildup of solids caused by evaporation.

2. The air inlet louver panel according to claim 1, wherein the anti-fouling coating comprises a ceramic polymer.

3. The air inlet louver panel according to claim 1, wherein the anti-fouling coating comprises a synthetic fluoropolymer of tetrafluoroethylene.

4. The air inlet louver panel according to claim 1, wherein the anti-fouling coating comprises aluminum magnesium boride ($AlMgB_{14}$).

5. The air inlet louver panel according to claim 1, wherein the core comprises an air permeable mesh.

6. The air inlet louver panel according to claim 1, wherein the core comprises at least one honeycomb construction layer.

7. The air inlet louver panel according to claim 1, wherein the core is fabricated from a thermoplastic selected from the group consisting of polyvinyl chloride, polypropylene, polyethylene, polycarbonate, acrylonitrile butadiene styrene, and combinations thereof.

8. A water cooling system, comprising:

a cooling tower having a basin; and an air inlet louver panel attached to the cooling tower, wherein the air inlet louver panel comprises:

a core having an outer surface;

a frame assembly attached to the core; and a anti-fouling coating in direct contact with at least a portion of the outer surface of the core, wherein the anti-fouling coating causes water to bead and not break surface tension such that water and dissolved solids slide off the air inlet louver panel.

9. The water cooling system according to claim 8, further comprising an eliminator positioned at a top portion of the cooling tower, wherein the eliminator permits passage of air while restricting passage of water.

10. The water cooling system according to claim 8, further comprising PVC filling positioned within the cooling tower, wherein the PVC filling reduces falling speed of water passing therethrough.

11. The water cooling system according to claim 8, further comprising spray nozzles positioned within the cooling tower for increasing surface area of water introduced into the cooling tower.

12. The water cooling system according to claim 8, wherein the anti-fouling coating comprises at least one of a ceramic polymer, a synthetic fluoropolymer of tetrafluoroethylene, and aluminum magnesium boride.

13. The water cooling system according to claim 8, wherein the core comprises polyvinyl chloride and wherein the frame assembly comprises stainless steel.

14. A method of reducing fouling in a water cooling tower, comprising the steps of:

providing a water cooling tower having an air inlet;

installing an air inlet louver panel at the air inlet, wherein the air inlet louver panel comprises a core having an outer surface, a frame assembly attached to the core, and a anti-fouling coating in direct contact with at least a portion of the outer surface of the core; and operating the water cooling tower, whereby the anti-fouling coating causes water contacting the air inlet louver panel to bead and not break surface tension such that water and dissolved solids slide off the air inlet louver panel, thereby reducing buildup of solids caused by evaporation.

15. The method according to claim 14, wherein the anti-fouling coating comprises a ceramic polymer.

16. The method according to claim 14, wherein the anti-fouling coating comprises a synthetic fluoropolymer of tetrafluoroethylene.

17. The method according to claim 14, wherein the anti-fouling coating comprises aluminum magnesium boride ($AlMgB_{14}$).

18. The method according to claim 14, further comprising the step of controlling algae growth within a basin of the water cooling tower by prohibiting sunlight from entering the basin via the air inlet louver panel.

19. The method according to claim 14, wherein the core comprises at least one honeycomb construction layer.

20. The method according to claim 14, wherein the anti-fouling coating is applied to the core by at least one of impregnating, etch coating, dip coating, spin coating, brush coating, and spray coating.

* * * * *